United States Patent [19]

Attwood

[11] 4,354,902

[45] Oct. 19, 1982

[54] FLOWBOX SYSTEM FOR WET-LAYING A MULTIPLY FIBROUS WEB

[76] Inventor: Brian W. Attwood, 155 Memorial Rd., Hanham, Bristol, England

[21] Appl. No.: 267,530

[22] Filed: May 27, 1981

[30] Foreign Application Priority Data

Jun. 21, 1980 [GB] United Kingdom ..... 8020411

[51] Int. Cl.[3] ..... D21F 1/02; D21F 1/04

[52] U.S. Cl. ..... 162/300; 162/304; 162/343; 162/345; 162/364; 162/370

[58] Field of Search ..... 162/300, 301, 302, 304, 162/343, 345, 326, 327, 298, 299, 336, 212, 328, 370, 363, 364, 258

[56] References Cited

U.S. PATENT DOCUMENTS

| | | | |
|---|---|---|---|
| 2,394,509 | 2/1946 | Boettinger | 162/343 |
| 3,190,790 | 6/1965 | Ploetz et al. | 162/299 |
| 3,598,696 | 8/1971 | Beck | 162/343 |
| 3,802,966 | 4/1974 | Delekto et al. | 162/343 |
| 4,083,750 | 4/1978 | Newrs et al. | 162/343 |

FOREIGN PATENT DOCUMENTS

| | | |
|---|---|---|
| 1179847 | 2/1970 | United Kingdom . |
| 1228385 | 4/1971 | United Kingdom . |
| 1335547 | 10/1973 | United Kingdom . |
| 1418057 | 12/1975 | United Kingdom . |
| 1519791 | 8/1978 | United Kingdom . |
| 1548925 | 7/1979 | United Kingdom . |
| 1585004 | 2/1981 | United Kingdom . |

*Primary Examiner*—Steve Alvo

*Attorney, Agent, or Firm*—Larson and Taylor

[57] ABSTRACT

A pair of enclosed explosion chamber flowboxes are combined so that the top exit slice plate of the first chamber provides the lower exit slice plate of the second chamber downstream of the first chamber so that pressurized furnishes for a two-ply web are laid one on top of the other over a very short distance.

1 Claim, 2 Drawing Figures

FLOWBOX SYSTEM FOR WET-LAYING A MULTIPLY FIBROUS WEB

This invention relates to improvements to flowboxes for machines for dewatering watery fibrous pulp or stock to form a sheet, e.g. in the manufacture of paper or board.

The invention particularly relates to improvements in the type of flowbox having a component known in the art as an "explosion chamber", which is a chamber in which a high speed stream of stock is very quickly changed in speed and direction of flow by rapid expansion and/or impingement on an obstruction within the chamber, whereby the stream disintegrates or "explodes" to cause mixing and deflocculation of the stock by the generation of turbulence. Typical such explosion chambers are described in our British Pat. Nos. 1179847 and 1548924.

A disadvantage of the prior art is that if it is required to lay a multiply sheet using the flowbox technique two or more flowboxes are necessary in line along a forming band, or it may be necessary to provide a number of flowboxes each associated with its own forming band, thereby utilising a large amount of space and machinery.

According to the present invention there is provided an integral flowbox system for wet-laying a multiply fibrous web on a moving foraminous band, comprising a plurality of enclosed explosion chambers each having a stock inlet and a stock outlet, the stock outlet being provided with at least one exit slice plate arranged to direct the stock onto the band, characterised in that the top slice plate of one chamber provides the lower slice plate of the adjacent chamber downstream of said one chamber.

Preferably adjacent explosion chambers have a wall in common provided by the downstream wall of one chamber and the upstream wall of the adjacent chamber downstream.

Each explosion chamber may be of the type in which the downstream and upstream walls converge form a top wall towards the foraminous band, the stock inlet being in one of the downstream and upstream walls and directed at the other downstream or upstream wall, and the stock outlet being at the bottom of one of the downstream and upstream walls.

Preferably stock inlets of adjacent explosion chambers are directed at the common wall.

It will be seen that the invention provides a compact integral flowbox system in which pressurised furnishes for a multiply web are laid one on top of the other over a very short distance. Thus a plurality of different furnishes can be supplied from a single compact flowbox system containing a plurality of explosion chambers.

Figure 1:
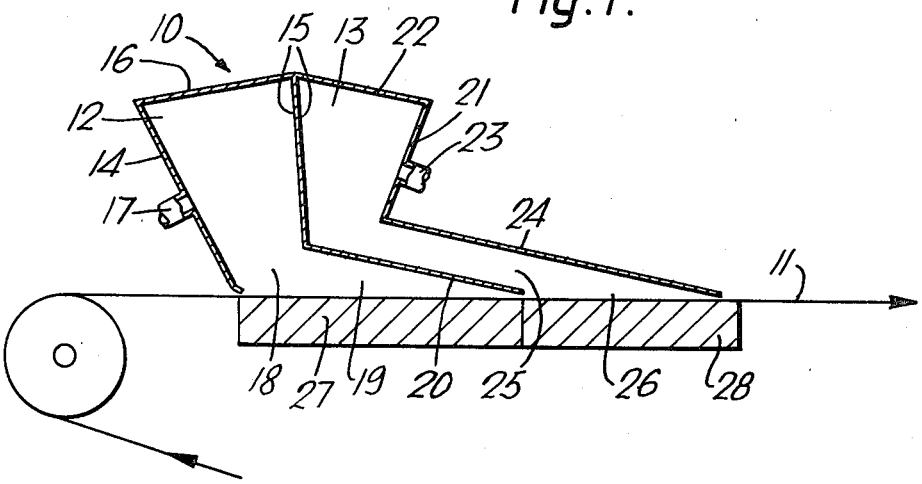
Figure 2:
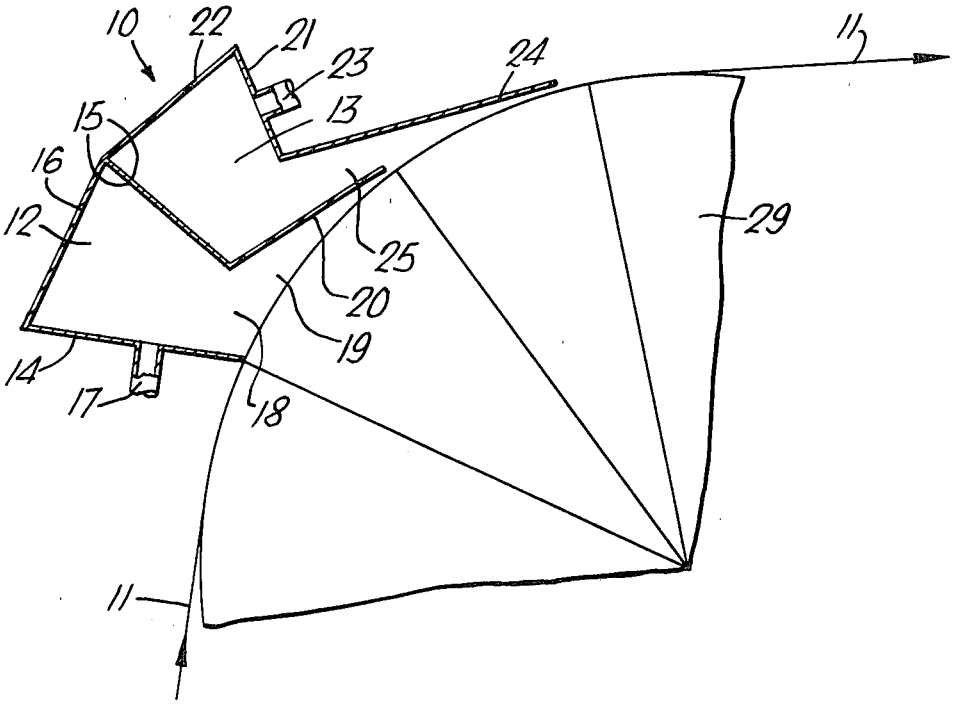

The invention will be described by way of example only with reference to the accompanying diagrammatic drawings in which, FIG. 1 is a cross-section side view of a multiply explosion chamber flowbox system and, FIG. 2 is a cross-section side view of the multiply explosion chamber flowbox system of FIG. 1 in combination with a suction cylinder mould.

Referring to the drawings there is shown an integral flowbox system 10 located over a moving foraminous forming band 11 and comprising a joined pair of explosion chambers 12, 13.

Upstream chamber 12 is provided with upstream and downstream walls 14, 15 respectively, converging downwardly from a top wall 16 towards the forming band 11. A stock inlet manifold for fibrous cellulosic stock indicated diagrammatically by inlet 17, is provided in upstream wall 14 and is directed away from the band towards the upper portion of downstream wall 15.

An outlet 18 is provided in the bottom portion of downstream wall 15 and communicates with a shear-flow passage or channel 19 defined between the band 11 and a slice plate 20 attached to the bottom portion of downstream wall 15 and directed downstream of the chamber 12 towards the band 11.

Chamber 13 is provided with an upstream wall which is the downstream wall 15 of chamber 12, and a downstream wall 21 which converges with wall 15 from a top wall 22 towards the band 11. An inlet 23, similar to inlet 17, is provided in wall 21 and is directed towards the top portion of wall 15. A slice plate 24 is attached to the bottom portion of downstream wall 21 and is directed downstream of the chamber 13 towards the band 11. Slice plate 20 of chamber 12 provides a lower slice plate for chamber 13, and, together with slice plate 24 (the upper slice plate) defines a shear-flow passage or channel 25 leading to a slice 26.

Hence, both explosion chambers 12, 13 have a wall 15 in common and the slice plate of one chamber provides a slice plate for the adjacent chamber. Thus, a first ply can be laid on band 11 by stock supplied through explosion chamber 12 and a second ply laid on top of the first ply immediately afterwards by a second source of stock supplied through explosion chamber 13. It will be seen that the explosion chambers 12, 13 by virtue of their common wall 15 and slice plate 20, effectively provide a very compact integral flowbox system which takes up little more space and construction material than the hitherto known single explosion chamber flowbox.

In FIG. 1, dewatering of the plies laid on the band 11 is provided by suction boxes 27, 28 beneath the band 11 and chambers 12, 13 respectively.

In a variant embodiment shown in FIG. 2B and 11 passes round a vacuum dewatering cylinder 29.

The stock inlet manifolds comprise a number of stock inlet tubes arranged in such a manner that when the stock enters the explosion chamber at high speed it is directed upwards to impinge against the opposite wall 15. The stock is then directed from wall 15 towards the top wall (16 or 22) and is caused to circulate violently in the chamber so that entangled cellulosic fibre clots in the stock are torn apart. The deflocculated stock then leaves the explosion chamber via the relatively narrow outlet at high speed and in a very turbulent state.

In a further embodiment more than two explosion chambers may be linked in the manner just described, the upper slice plate of one explosion chamber being the lower slice plate of the adjacent explosion chamber downstream. In such a configuration the inlet manifold to an explosion may have to pass between the downstream wall of one explosion chamber and the upstream wall of the adjacent explosion chamber downstream.

In yet a further embodiment the invention may utilise the explosion chambers disclosed in our British Pat. No. 1179847.

Modifications may be made to the explosion chambers, the slice plates or ancilliary dewatering equipment in accordance with the disclosures of our British Pat. Nos. 1179847, 1519791, 1548924 and 1548925.

I claim:

1. An integral flowbox system for wet-laying a multiply fibrous web on a moving foraminous wire, comprising a pair of enclosed explosion chambers arranged respectively upstream and downstream with regard to the direction of movement of the wire, the downstream wall of the upstream chamber being in common with the upstream wall of the downstream chamber, the downstream and upstream walls of each chamber converging from a top wall towards the wire, each chamber being provided with a stock inlet directed at their common wall and a stock outlet at the bottom of the chamber, the stock outlets comprising slice plates defining respective shear flow passages for delivering the stock from the explosion chambers onto the wire, one said slice plate being common to both flow passages and an extension of said common wall of the explosion chambers, and suction means below the wire under each stock outlet extending from the upstream wall to the downstream wall of each stock outlet whereby the layer of stock from the upstream outlet is immediately dewatered prior to the layer from the downstream outlet being laid thereon.

* * * * *